US006719588B1

(12) United States Patent
Zheng et al.

(10) Patent No.: US 6,719,588 B1
(45) Date of Patent: Apr. 13, 2004

(54) MODULAR JACK HAVING A TERMINAL MODULE LOCKED IN A HOUSING

(75) Inventors: Qisheng Zheng, Kunsan (CN); Qin Wan, Kunsan (CN); Hongjun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/340,328

(22) Filed: Jan. 10, 2003

(30) Foreign Application Priority Data

Dec. 20, 2002 (TW) ..... 91220805 U

(51) Int. Cl.[7] ..... H01R 24/00
(52) U.S. Cl. ..... 439/620; 439/676
(58) Field of Search ..... 439/620, 676, 439/344, 76.1, 752, 941, 701, 682

(56) References Cited

U.S. PATENT DOCUMENTS 4,274,691 A * 6/1981 Abernethy et al. ..... 439/676
5,674,093 A * 10/1997 Vaden ..... 439/676
5,885,111 A * 3/1999 Yu ..... 439/676
5,989,069 A * 11/1999 Tan ..... 439/620
6,203,379 B1 * 3/2001 Cai et al. ..... 439/676
6,319,047 B1 * 11/2001 Kang ..... 439/676
6,319,062 B1 * 11/2001 Ma et al. ..... 439/607
6,328,595 B1 * 12/2001 Chang ..... 439/620
6,354,884 B1 * 3/2002 Yeh et al. ..... 439/680
6,368,151 B1 4/2002 Chen et al.
6,431,918 B1 * 8/2002 Givens et al. ..... 439/676
6,450,837 B1 * 9/2002 Givens et al. ..... 439/620
6,457,993 B1 * 10/2002 Espenshade ..... 439/489
2003/0119370 A1 * 6/2003 Xu et al. ..... 439/676

* cited by examiner

*Primary Examiner*—Renee Luebke
*Assistant Examiner*—Felix O. Figueroa
(74) *Attorney, Agent, or Firm*—WeiTe Chung

(57) ABSTRACT

A modular jack (1) including a dielectric housing (10) and a terminal module (20) inserted in the housing. The housing includes a pair of opposite side walls (100) and opposite top and bottom walls (101,102) perpendicular to the pair of side walls. A room (103) is defined by the top wall, bottom wall and side walls to receive the terminal module. The bottom wall has a pair of first locking protrusion (107) defined on an upper surface. The terminal module includes a dielectric plate (200) and a plurality of terminals (201) insert molded in the plate. The plate has a pair of second locking recesses (204) defined on a lower surface. The terminal module is locked in the housing, via the first locking protrusion projecting into the second locking recesses, thereby preventing the terminal module from offsetting from the housing.

5 Claims, 4 Drawing Sheets

MODULAR JACK HAVING A TERMINAL MODULE LOCKED IN A HOUSING

BACKGROUND OF THE INVENTION

1. Field of the Invention

This invention relates to a modular jack, and more particularly to a modular jack having a terminal module locked in a housing.

2. Description of Related Art

Modular jack are widely used in network system. Such a conventional modular jack is, for example, typically disclosed in U.S. Pat. Nos. 6,457,993; 6,450,837; 6,431,918; 6,368,151; 6,354,884; 6,319,062; 6,203,379; and 5,674,093. The modular jack comprises a dielectric housing and a terminal module inserted in the housing. The housing includes a pair of opposite side walls, and opposite top and bottom walls perpendicular to the pair of side walls. A room is defined by the top wall, bottom wall and side walls to receive the terminal module for mating a mating modular plug. The terminal module includes a dielectric plate and a plurality of terminals insert molded in the plate. The terminal module is secured in the room via the interference engagement between the side walls of the housing and the plate of the terminal module.

However, since the terminal module is not locked in the housing, so the terminal module has a risk to offset from the housing which consequently induces the modular jack can not electrically engage with the mating modular plug.

Hence, an improved modular jack is required to overcome the disadvantages of the prior art.

SUMMARY OF THE INVENTION

An object of the present invention is to provide a modular jack having a terminal module locked in a housing.

To fulfill the above-mentioned object, a modular jack according to the present invention comprises a dielectric housing and a terminal module inserted in the housing. The housing includes a pair of opposite side walls and opposite top and bottom walls perpendicular to the pair of side walls. A room is defined by the top wall, bottom wall and side walls to receive the terminal module for mating a mating modular plug. The bottom wall has a pair of first locking means defined on an upper surface thereof. The terminal module includes a dielectric plate and a plurality of terminals insert molded in the plate. The plate has a pair of second locking means defined on a lower surface thereof. The terminal module is locked in the housing via the first locking means projecting into the second locking means, thereby preventing the terminal module from offsetting from the housing.

In this design, the housing and the terminal module respectively has first locking means and second locking means, the terminal module is locked in the housing via the first locking means projecting into the second locking means. So the terminal module has no risk to offset from the housing thereby ensure the modular jack electrically engage with the mating modular plug.

Other objects, advantages and novel features of the invention will become more apparent from the following detailed description when taken in conjunction with the accompanying drawings.

DETAILED DESCRIPTION OF THE INVENTION

Figure 1:
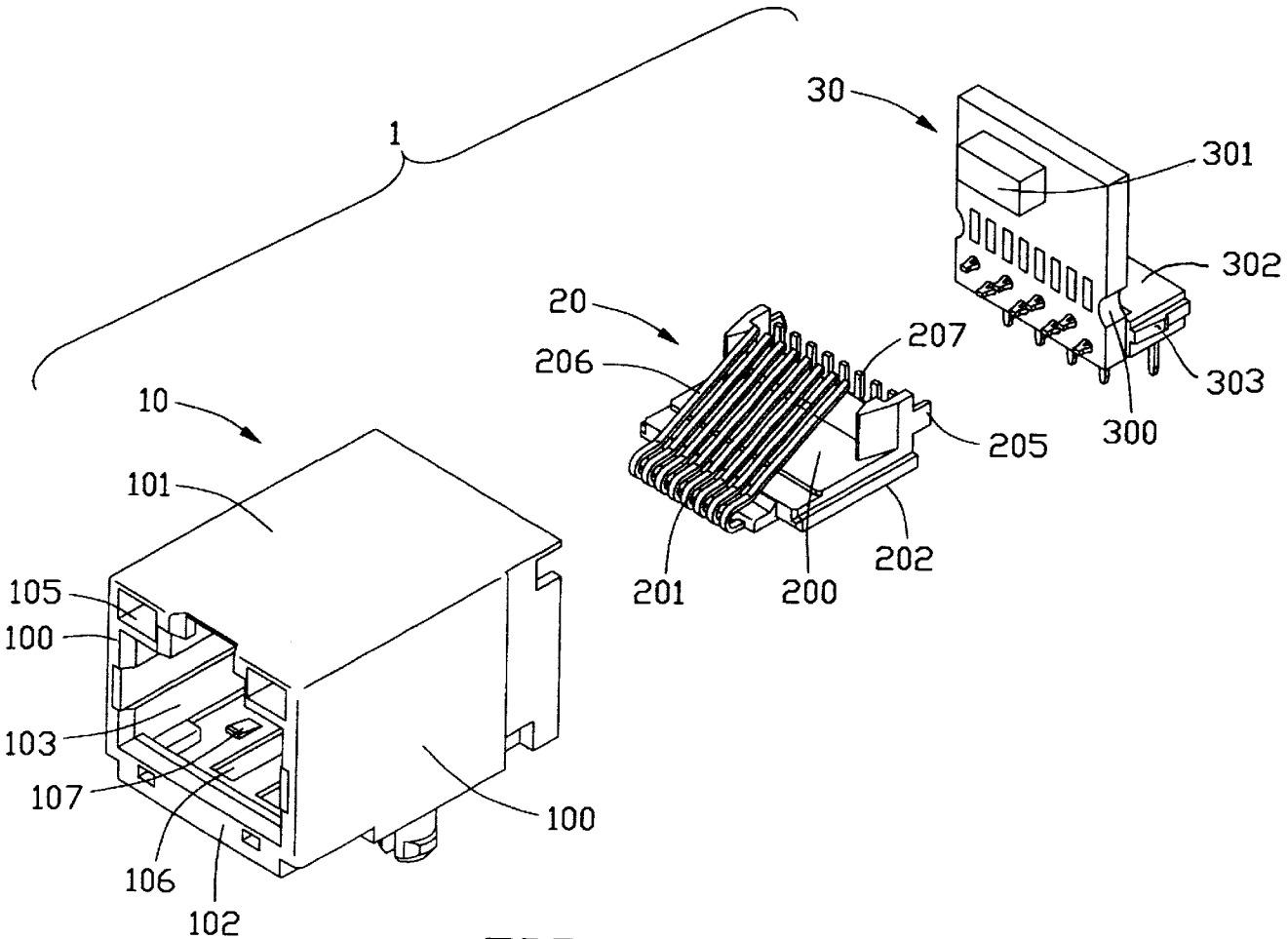
FIG. 1 is an exploded view of a modular jack according to the present invention.
Figure 2:
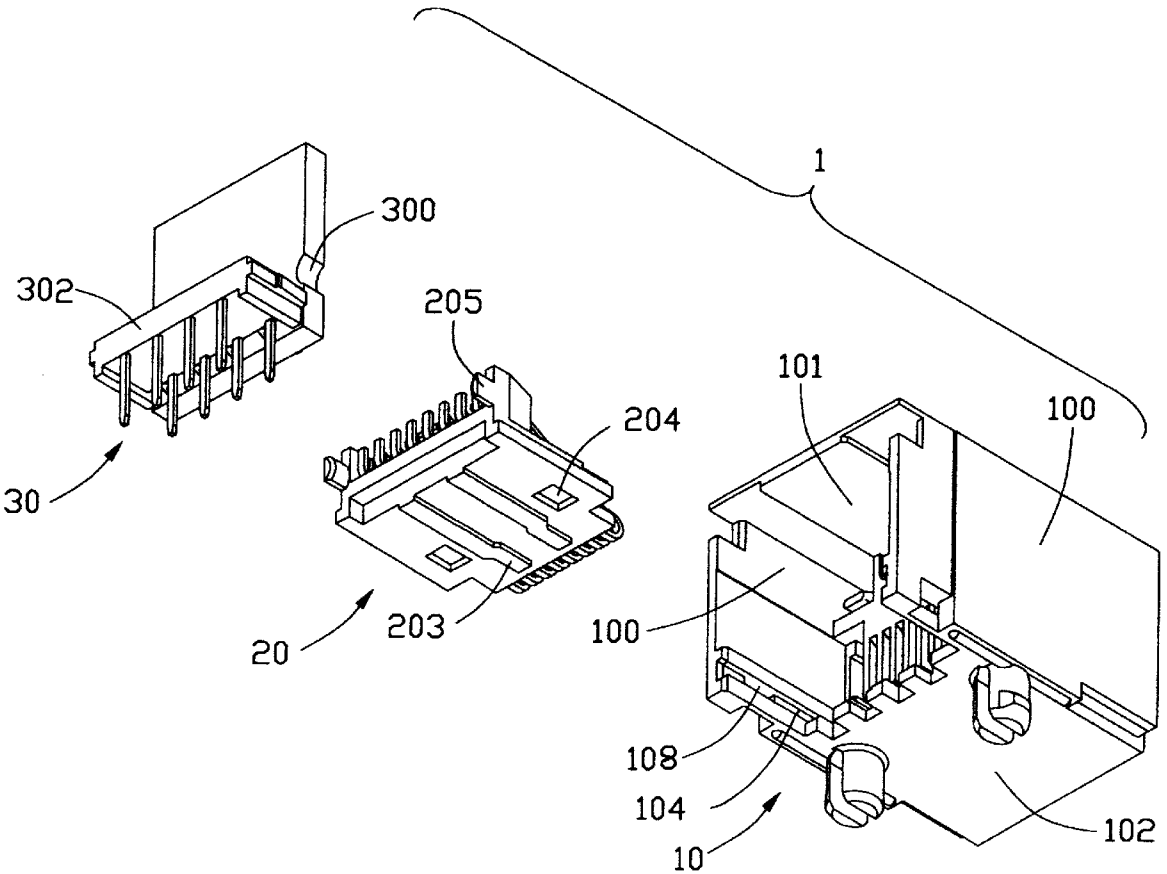
FIG. 2 is another exploded view of the modular jack in FIG. 1.

Referring to FIG. 1 and FIG. 2, a modular jack 1 according to the present invention comprises a dielectric housing 10, a terminal module 20, and a printed circuit board (PCB) 30. The housing 10 includes a pair of opposite side walls 100, and opposite top and bottom walls 101, 102 perpendicular to the pair of side walls 100. A room 103 is defined by the top wall 101, bottom wall 102, and side walls 100 to receive the terminal module 20 for mating a mating modular plug (not shown). Each side wall 100 has a first guide channel 104 defined on a lower portion of an inner surface thereof. The top wall defines a pair of receiving channels 105 for receiving indication devices (not shown). A pair of second guide channels 106 and a pair of first locking means 107 are disposed on an upper surface of the lower wall 102. In the present embodiment, the each first locking means 107 is a protrusion having a trapezium shape. A pair of locking holes 108 are formed in the housing 10 in communication with the guide channels 104.

The terminal module 20 includes a dielectric plate 200 and a plurality of terminals 201 insert molded in the plate 200. The plate 200 has a pair of first guide slips 202 defined on opposite side edges thereof. A pair of second guide slips 203 and a pair of second locking means 204 are disposed on a lower surface of the plate 200. In the present embodiment, each second locking means 204 is a slot. The plate 200 further defines a pair of locating protrusion 205 on opposite sides of a rear portion thereof. Each terminal 201 includes a contact portion 206 bending extended above the upper surface of the plate 200 for contacting with terminals of the mating modular plug, and a solder portion 207 extending beyond the rear portion of the plate for soldering with the PCB 30.

Corresponding to the pair of locating protrusions 205 of the plate 200, the PCB 30 defines a pair of locating slots 300 on opposite side edges. Each locating slot 300 is in half-circularity shape design. It's easy to manufactured, and precisely located. The PCB 30 further has a plurality of electric components 301 disposed on one surface thereon for performing multi-functions, for example, signal filtering. A tail insert 302 is fixed on the other surface of the PCB 30 with a right angle configuration for mounting to a mother board (not shown) on which the modular jack 1 is seated. The tail insert 302 includes a pair of locking projections 303 retained in the locking holes 108 of the housing 10.

Figure 3:
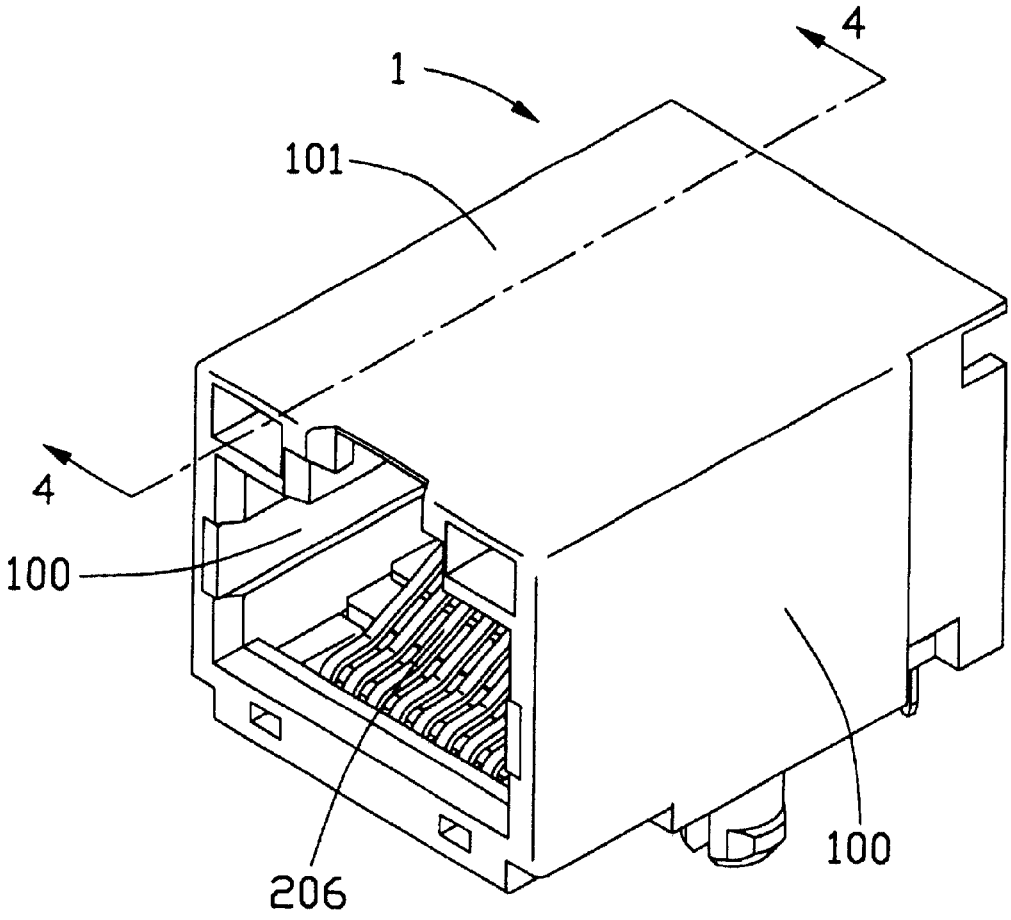
FIG. 3 is a assembled perspective view of the modular jack in FIG. 1.
Figure 4:
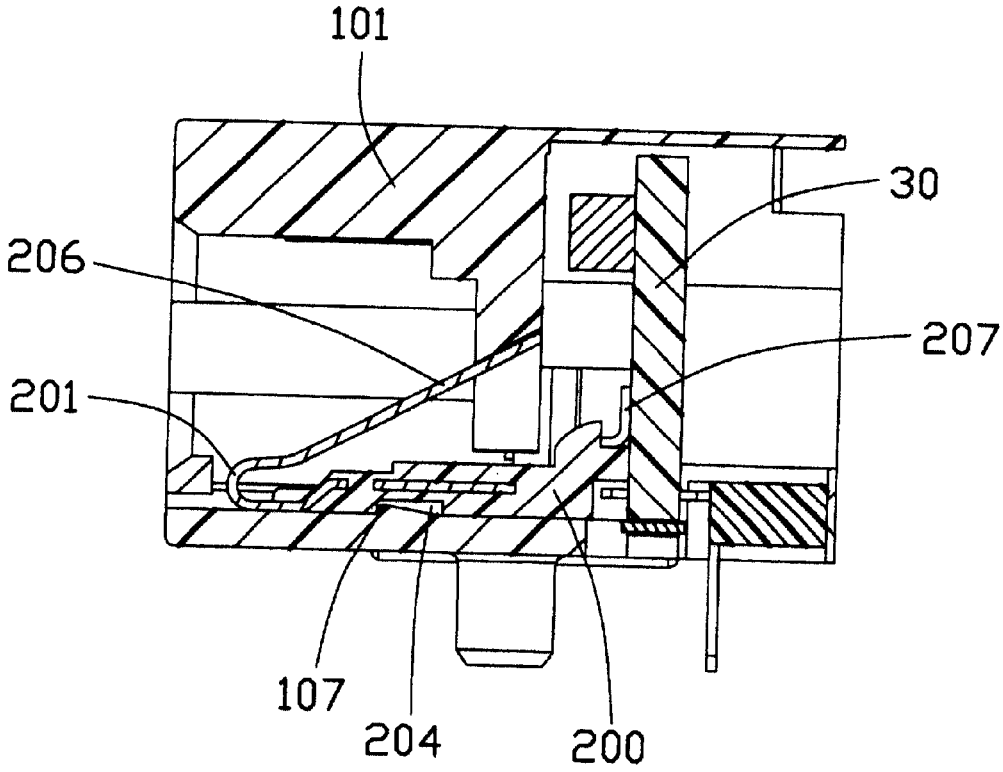
FIG. 4 is a cross-sectional view taken along the line 4—4 of FIG. 3.

Referring to FIG. 3 and FIG. 4, in assembly, the PCB 30 is aligned with the terminal module 20 via the locating protrusions 205 of the plate 200 located in the locating slots 300 of the PCB 30, and then soldered with the solder portion 207 of the terminals 201. The terminal module 20 is assembled into the room 103 of the housing 10 from a rear surface of the housing 10, via the cooperation of the first guide slips 202 and the first guide channels 104, and the cooperation of the second guide slips 203 and the second guide channels 106. The terminal module 20 is locked in the housing 10, via the first locking means 107 projecting into the second locking means 204. The contact portions 206 of the terminals 201 project into the room 103 of the housing 10 for electrically contacting with the mating modular plug. Thus, via the PCB 30, the terminal module 30 can be electrically connected to the tail insert 302 so as to have the aforementioned mating modular jack (not shown) electrically connected to the mother board (not shown).

The modular jack 1 may further comprises a shell enclosing the housing for preventing electro magnetic interference (EMI).

Compared to the prior art, the housing 10 and the terminal module 20 according to the present invention respectively has first locking means 107 and second locking means 204. The terminal module 20 is locked in the housing 10, via the first locking means 107 projecting into the second locking means 204. So the terminal module 20 has no risk to offset from the housing 10, thereby ensure the modular jack 1 electrically engage with the mating modular plug.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack, comprising:

a dielectric housing having a pair of opposite side walls, opposite top and bottom walls with a room defined therewithin;

a terminal module assembled in the room of the housing, and including a dielectric plate and a plurality of terminals insert molded in the plate; and interlocking means arranged between the housing and the terminal module, thereby preventing the terminal module from offsetting from the housing;

wherein the interlocking means are a pair of first locking means defined on an upper surface of the bottom wall of the housing and a pair of second locking means defined on a lower surface of the plate of the terminal module;

wherein the first locking means is a protrusion having a trapezium shape seeing from side thereof, and the second locking means is a slot;

wherein each side wall of the housing has a first guide channel defined on a lower portion of an inner surface thereof, and the plate of the terminal module has a pair of first guide slips defined on opposite side edges thereof, corresponding to the first guide channels;

wherein the bottom wall of the housing has second guide channels defined on the upper surface thereof, and the plate of the terminal module has second guide slips defined on the lower surface thereof, corresponding to the second guide channels.

2. The modular jack of claim 1, wherein the modular jack further includes a printed circuit board (PCB) soldering with the terminals of the terminal module.

3. The modular jack of claim 2, wherein the PCB has a pair of locating slots defined on opposite side edges thereof.

4. The modular jack of claim 3, wherein each locating slot is in half-circularity shape design.

5. The modular jack of claim 4, wherein the plate has a pair of locating protrusions defined on opposite sides of a rear portion thereof corresponding to the locating slots of the PCB.

* * * * *